United States Patent [19]

Lammert

[11] Patent Number: 5,056,327

[45] Date of Patent: Oct. 15, 1991

[54] HOT GAS DEFROST REFRIGERATION SYSTEM

[75] Inventor: Paul F. Lammert, Danville, Ill.

[73] Assignee: Heatcraft, Inc., Grenada, Miss.

[21] Appl. No.: 484,922

[22] Filed: Feb. 26, 1990

[51] Int. Cl.[5] ..... F25D 21/06; F25B 47/02

[52] U.S. Cl. ..... 62/151; 62/196.4; 62/205; 62/278; 62/513

[58] Field of Search ..... 62/151, 196.4, 277, 62/278, 205, 224, 225, 222, 81, 113, 197, 513

[56] References Cited

U.S. PATENT DOCUMENTS

| | | | |
|---|---|---|---|
| 1,378,026 | 5/1921 | Hansen | 62/222 X |
| 2,691,276 | 10/1954 | Trask | 62/222 |
| 2,770,104 | 11/1956 | Sweynor | 62/117.55 |
| 3,786,651 | 1/1974 | Eschbaugh | 62/222 |
| 3,967,782 | 7/1976 | Eschbaugh | 236/92 |
| 4,083,195 | 4/1978 | Kramer et al. | 62/196 |
| 4,095,438 | 6/1978 | Kramer | 62/278 |
| 4,102,151 | 7/1978 | Kramer et al. | 62/278 |
| 4,343,157 | 8/1982 | Hattori | 62/278 X |
| 4,798,058 | 1/1989 | Gregory | 62/278 |

OTHER PUBLICATIONS

Bulletin 413.3—Medium Profile-Hot Gas Defrost Unit Collers—Wickes Manufacturing Company, Bohn Heat Transfer Division, 1986.

Bulletin 0 & 1413.3—Operating and Installation Instructions, Model MPG (Rev.F)—Wickes Mfg. Co., Bohn Heat Transfer Div., 1986.

*Primary Examiner*—Harry B. Tanner

*Attorney, Agent, or Firm*—Allegretti & Witcoff, Ltd.

[57] ABSTRACT

A hot gas defrost refrigeration system has a compressor, a condenser, a receiver, an evaporator, interconnected by fluid passage means and incorporating valve means to cause refrigerant to flow sequentially through the compressor, condenser, receiver and evaporator to the compressor during the refrigeration cycle. The refrigeration system includes a superheater and defrost passage means, including valve means, connecting the evaporator outlet to the condenser inlet and connecting the condenser outlet through the superheater to the compressor inlet, bypassing the receiver. The passage means connecting the compressor outlet with the evaporator inlet includes a superheat passage in heat exchange relationship with the superheater for transferring heat from the refrigerant discharged from the compressor outlet to the refrigerant delivered to the compressor inlet during the defrost cycle. During the defrost cycle, refrigerant flows sequentially from the compressor to the evaporator, then through the defrost passage means to the condenser and then to the superheater to the compressor. The condenser is utilized as a reevaporator during defrost and the superheater exchanges heat between compressor inlet and suction refrigerant to enhance system operation during the defrost cycle.

40 Claims, 4 Drawing Sheets

HOT GAS DEFROST REFRIGERATION SYSTEM

FIELD OF THE INVENTION

This invention relates generally to refrigeration systems and, more specifically, to commercial refrigeration systems using a hot gas defrost cycle to defrost a frosted evaporator.

BACKGROUND OF THE INVENTION

A common method of defrosting a commercial refrigeration system frosted evaporator is to halt the refrigeration cycle and activate electric heaters in the evaporator. This method is time consuming and often leads to temperature cycling of the refrigerated space. This cycling can drastically affect the life of the product, frequently foodstuff, being cooled in the refrigerated space.

Commercial refrigeration systems which utilize a hot gas defrost cycle have been in use for many years. In one such arrangement, the refrigeration cycle is merely reversed to cause hot vaporous refrigerant from the compressor to cycle in reverse into the evaporator outlet, through the evaporator, out its inlet to the condenser outlet, through the condenser, out its inlet and back to the compressor. The systems have proved to be very inefficient.

Another method of hot gas defrost is illustrated in U.S. Pat. No. 2,770,104—Sweynor, which describes an older system. That system merely bypassed the condenser in the defrost cycle, an arrangement found to be unsuitable for two reasons. Since the temperature of refrigerant in the compressor suction line was too low, it produced some liquid which entered the compressor, ultimately causing compressor damage. Also, the temperature of the vaporous refrigerant delivered to the evaporator during the defrost cycle was found to be too cool to effect rapid defrosting.

The Sweynor improvement added a means of superheating the refrigerant discharged by the compressor and delivered to the evaporator. This heat was provided by electrically heating a tank filled with water through which the compressor discharge line was routed. Since heat was added to the defrosting cycle, this also raised the temperature of the suction refrigerant. This arrangement added an expensive heater, electricity cost, and heater maintenance cost. It also had the unfortunate result of so heating the evaporator inlet refrigerant temperature that a commercial system having many feet of evaporator inlet tubing would experience sufficient tubing growth to distort and break tubing.

More recently, a system which effects evaporator defrosting in a different manner has met with some commercial success. This is disclosed in U.S. Pat. No. 4,102,151—Kramer et al. This patent relates a hot gas defrost system in which vaporous refrigerant discharged from the compressor during the defrost cycle is routed through a tank filled with water, thus transferring heat to the water and desuperheating the refrigerant delivered to the evaporator. The evaporator discharge line is then routed through this water tank only during the defrost cycle to theoretically superheat the compressor suction refrigerant sufficiently to assure complete vaporization.

However, in practice the assignee of the Kramer patent has found that auxiliary heat is needed for the water tank (located outside) to prevent freezing in the winter. This arrangement thus suffers from several of the drawbacks found with the arrangement disclosed in the above Sweynor patent.

There is a need for a hot gas defrost refrigeration system which is simple, inexpensive and does not rely on external sources of heat for operation.

SUMMARY OF THE INVENTION

It is therefore an object of this invention to provide a refrigeration system which accomplishes defrosting of a frosting evaporator simply, inexpensively and without use of outside sources of heat.

In accordance therewith, this invention comprises a hot gas defrost refrigeration system having a compressor, a condenser, and an evaporator, each having inlets and outlets interconnected by fluid passage means. It incorporates valve means to cause refrigerant to flow sequentially through the compressor, the condenser, the evaporator and back to the compressor during the refrigeration cycle, and to flow sequentially through the compressor, the evaporator and back to the compressor during the defrost cycle. This system is characterized by defrost passage means for directing refrigerant from the evaporator outlet to the condenser inlet and from the condenser outlet to the compressor inlet during the defrost cycle, thereby utilizing the condenser as a reevaporator during the defrost cycle.

This hot gas defrost refrigeration system is further characterized by including a superheater in the defrost passage means which is adapted to receive refrigerant from the condenser outlet during the defrost cycle; the passage means connecting the compressor outlet with the evaporator inlet includes a superheat passage in heat exchange relationship with the superheater for transferring heat from the refrigerant discharged from the compressor outlet to the refrigerant delivered to the compressor inlet to enhance operation of the system during the defrost cycle.

Thus this invention provides for hot gas defrost of a frosting evaporator by a system which utilizes heat from the compressor discharge refrigerant to superheat the compressor suction refrigerant. This assures that suction refrigerant is completely vaporous, and also enables desuperheating of the compressor discharge refrigerant to reduce the deleterious effect of growth of the evaporator inlet conduit or tubing.

These and further features and advantages of this invention will become more readily apparent upon reference to the following detailed description of the invention, as illustrated in the accompanying drawings, in which:

DETAILED DESCRIPTION OF THE INVENTION

Figure 1:
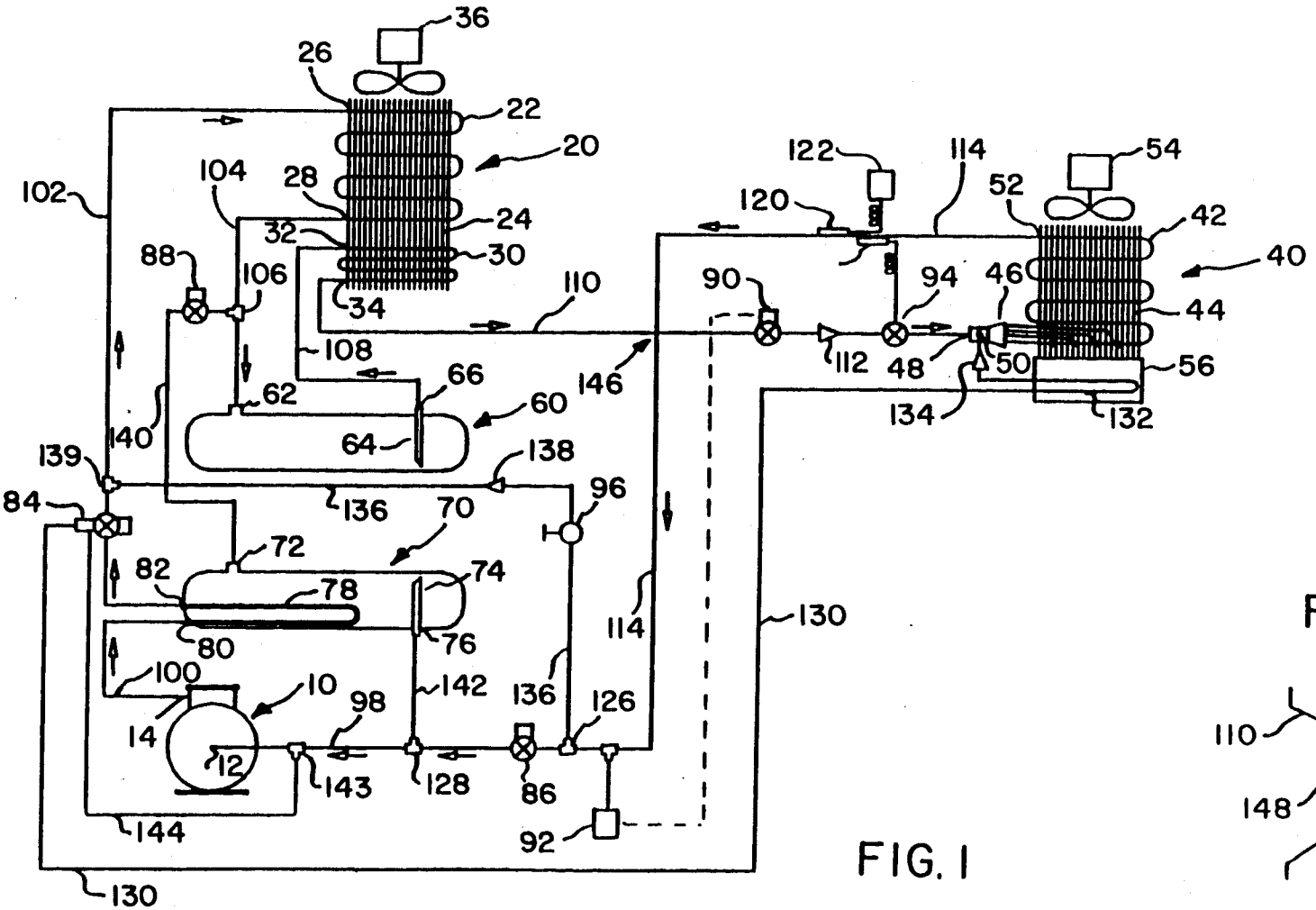
FIG. 1 is a schematic diagram of one embodiment of a refrigeration system according to this invention, illustrating system operation during the refrigeration cycle.

FIG. 1 depicts a hot gas defrost refrigeration system, according to this invention, which includes a refrigerant compressor 10 of any conventional type. A suction port 12 and a discharge port 14 are provided for translating refrigerant through compressor 10 where it is compressed and thus heated.

A refrigerant condenser 20 is provided with tubing coils 22 which undulate through a spaced stack of heat exchange fins or plates. Condenser 20 includes an inlet 26 and an outlet 28 for transferring refrigerant through coils 22. A subcooling loop of coils 30, having inlet 32 and outlet 34 similarly snake through fins 24. Condenser 20 is conventionally placed exteriorly of a building which contains a space, or room, to be refrigerated (not shown). An electric fan 36 is supplied to blow ambient air through fins 24 to exchange heat between refrigerant flowing through coils 22 and 30 and the air.

A refrigerant evaporator 40 is provided for cooling the refrigerated space, and includes tubing coils 42 which undulate through a spaced stack of heat exchange fins 44. A side-ported distributor 46 is supplied with liquid refrigerant through either a refrigeration cycle inlet 48, or a defrost cycle inlet 50, as will be later described. Refrigerant exits the coils 42 of evaporator 40 through an outlet 52. An electric fan 54 may be selectively activated to blow air in the refrigerated space through fins 44 to exchange heat from the air to the refrigerant flowing through coils 42 during the refrigerating cycle, as later described. A drain pan 56 sits beneath evaporator 40 to collect water which drips off coils 42 as they are defrosted, as later detailed.

The refrigeration system further includes a refrigerant receiver 60 having an inlet 62 and a dip tube 64 connected to an outlet 66. In accordance with this invention, a superheater 70 is provided for a purpose later explained. It includes an inlet 72, a standpipe 74 connected to an outlet 76, and a superheat conduit 78 having an inlet 80 and an outlet 82.

Refrigerant is transferred among compressor 10, condenser 20, evaporator 40, receiver 60 and superheater 70 by fluid passage and control means which includes several valves that will now be described. Distribution of compressed refrigerant vapor discharged from compressor 10 is controlled by a solenoid-operated compressor discharge valve 84, while a solenoid-operated compressor suction valve 86 is provided to control the source of refrigerant vapor inflow to the compressor.

Distribution of refrigerant discharged from condenser 20 is controlled by a solenoid-operated condenser discharge valve 88. The source of supply of refrigerant to evaporator 40 is regulated by a solenoid-operated evaporator supply valve 90. Operation of valve 90 is controlled by a compressor suction pressure sensor 92. A refrigeration cycle expansion valve 94 is provided to supply refrigerant to evaporator distributor 46 during the refrigeration cycle. Valve 94 is preferrably a "Bohnmizer" valve comercially available from inventor's assignee. This valve is disclosed in U.S. Pat. Nos. 3,786,651 and 3,967,782 to Eschbaugh et al. A pressure regulating valve 96 regulates the flow of refrigerant to the condenser during the defrost cycle.

The fluid passage means for translating refrigerant as directed by the above valves will now be described. Compressed vaporous refrigerant is discharged from compressor 10 through a conduit 100, which incorporates superheat conduit 78, that connects to discharge valve 84. Valve 84 has several outlet ports, one of which connects to a condenser supply conduit 102 which is connected to condenser inlet 26. Condenser outlet 28 connects to a discharge conduit 104 that includes a tee and is attached at its other end to receiver inlet 62. A conduit 108 connects receiver outlet 66 with subcool loop inlet 32, while subcool loop outlet 34 connects to one end of the evaporator refrigerant cycle supply conduit 110. The other end of conduit 110 attaches to refrigeration inlet 48 of distributor 46. Conduit 110 incorporates evaporator supply valve 90, a check valve 112 and the refrigeration cycle expansion valve 94.

Refrigerant is discharged from evaporator outlet 52 into a conduit 114 and has its temperature monitored by a temperature sensor 120 of the system defrost cycle controller 122, and by temperature sensor 124 of expansion valve 94. Pressure in conduit 114 is monitored by pressure controller 92 of evaporator supply valve 90. Conduit 114 incorporates a tee 126 and terminates at compressor suction valve 86. The compressor suction conduit 98 conveys vaporous refrigerant from valve 86 to compressor 10.

The other outlet port of compressor discharge valve 84 connects to a conduit 130 which conveys refrigerant to the evaporator 40. It includes a loop 132, that is in heat exchange relationship with evaporator drain pan 56, and connects through a check valve 134 to the side port 50 of refrigerant distributor 46. A defrost bypass conduit 136 is connected to tee 126 and extends through a self-modulating pressure control valve 96 that has a manually-adjustable orifice. Conduit 136 extends through a check valve 138 to a tee 139 in conduit 102.

Refrigerant discharged from condenser 20 can exit conduit 104 at tee 106 and flow through valve 88 into defrost bypass conduit 140 and into superheater 70 through inlet 72. Fluid drawn out of superheater 70 through standpipe 74 exits outlet 76 into conduit 142 and flows through tee 128 into suction conduit 98, past a tee 143 and into suction port 12. Valve 84 a bleed port which functions to bleed conduit 130 through a bleed line 144 and tee 143 to suction conduit 98 when valve 84 is connected to conduit 102.

Figure 2:
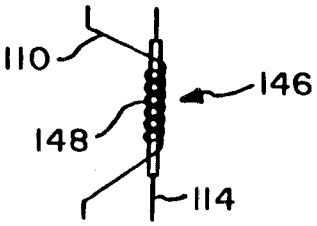
FIG. 2 is a schematic depiction of a heat exchanger which can be used with the FIG. 1 embodiment.

As shown in FIG. 2, conduits 110 and 114 may intersect at 146 in heat exchange relationship wherein conduit 110 includes coils 148 surrounding conduit 114. This enables heat transfer from the hot liquid refrigerant entering the evaporator distributor 46 to the cool vaporous refrigerant discharged from the evaporator outlet 52. This desuperheats refrigerant entering evaporator 40 from conduit 110 and superheat evaporator discharge refrigerant in conduit 114 which flows to the compressor.

Operation of the system during the refrigeration cycle will now be described with reference to FIG. 1 which includes directional arrows to indicate the direction of refrigerant flow through the system. At the initiation of the refrigeration cycle, solenoid valve 88 is closed, and solenoid valves 86 and 90 are opened. Valve 84 is shifted to outlet to conduit 102.

Refrigerant supplied to compressor 10 from conduit 98 is compressed and discharged through conduit 100 to valve 84. During this cycle, there is no refrigerant in superheater 70, so no heat transfer occurs. Valve 84 discharges this hot vaporous refrigerant through conduit 102 to condenser 20, where it is condensed during its journey through coils 22 by the cooling ambient air blown over fins 24 by fan 36. Refrigerant in conduit 102 is prevented from entering conduit 136 and short-circuiting to compressor suction conduit 98 by check valve 138. This condensed refrigerant is discharged through conduit 104 to receiver 60. During the refrigeration cycle, valve 88 is closed so that no refrigerant can flow through conduit 140.

Refrigerant is withdrawn from receiver 60 through dip tube 64 and flows through subcooling loop 30 where it is further cooled to assure that only liquid refrigerant is delivered to evaporator 40. Refrigerant flows through conduit 110, through valve 90, which is usually conventionally opened and closed in response to refrigeration requirements in the refrigerated space during this cycle, although it may be selectively closed as later described. Flow continues through check valve 112, expansion valve 94 and distributor 46 into coil 42. Refrigerant flow through distributor side port 50 into heating loop 132 is prevented by check valve 134.

Refrigerant vaporizes in coil 42 and absorbs heat from the ambient air in the refrigerated space which is blown over fins 44 by fan 54. Vaporous refrigerant is discharged from evaporator 40 into conduit 114. Temperature sensor 124 monitors refrigerant temperature in conduit 114 and modulates refrigerant flow through expansion valve 94, thereby controlling the superheat temperature of refrigerant discharged into conduit 114. Refrigerant flow into conduit 114, and into suction conduit 98, from conduit 102 through conduit 136 (a short circuit) is prevented by check valve 138. Since solenoid valve 86 is open during the refrigeration cycle, vaporous refrigerant flows through it. Refrigerant flow through conduit 142, superheater 70 and conduit 140 is prevented by solenoid valve 88 which is closed during this cycle. Refrigerant then flows through suction port 12 into compressor 10 to begin a new refrigerating cycle.

During refrigerating operation, evaporator 40 will gradually frost over, thus severely reducing heat transfer from ambient air to refrigerant. Periodically, the system controller will command that the refrigeration cycle be halted and a defrost cycle be initiated. This operation will now be described with reference to FIG. 4, which includes directional arrows to indicate the direction of refrigerant flow during this cycle. At this time, solenoid valves 86 and 90 are closed, and solenoid valve 88 is opened. Valve 84 is shifted to outlet to conduit 130 and evaporator fan 54 is turned off.

Closing of valve 86 suddenly changes the source of refrigerant for compressor suction. Any liquid refrigerant in condenser 20, in receiver 60, and in conduit 110 will flow into superheater 70 where it will be rapidly vaporized by compressor suction, since it can enter standpipe 74 only as a vapor. Vaporous refrigerant will enter compressor suction conduit from superheater 70 and conduit 142. Hot vaporous refrigerant is discharged from compressor 10 through conduit 100, through superheat loop 78, and through valve 84 into conduit 130. This refrigerant is delivered to drain pan heating loop 132, through side port 50 of distributor 46 and into evaporator coil 42. As the hot vaporous refrigerant courses through coil 42, it begins melting the frost which has collected on the coils 42 and fins 44 during refrigeration. Upon melting, the water drips into pan 56 and is drained outside the refrigerated space. Heat supplied to pan 56 by the hot vaporous refrigerant in drain heating loop 132 prevents freezing of water in the pan.

As the vaporous refrigerant traverses coil 42, it is cooled and condensed, emerging from outlet 52 as a liquid which flows into conduit 114. Since solenoid valve 86 is closed, refrigerant enters defrost bypass conduit 136, where the pressure regulating valve 96 functions as a defrost cycle expansion valve. This valve is a self-modulating valve having a manually adjustable orifice. Refrigerant flows through check valve 138 and into evaporator supply conduit 102. Since the outlet from valve 84 to conduit 102 is closed, refrigerant flows into condenser 20.

One feature of this invention is the use of the condenser as a reevaporator during the defrost cycle. Heat transfers to the refrigerant flowing through coils 22 from the ambient air blown over fins 24 by fan 36 and the refrigerant is vaporized as it traverses coil 22. It exits outlet 32 into conduit 104 as vaporous refrigerant. Backpressure in conduit 110 and 108 forces refrigerant past now-open valve 88 into conduit 140 and into superheater 70. The cool vaporous refrigerant in superheater 70 is superheated by the hot vaporous refrigerant discharged from compressor 10 through superheat conduit 78. Conversely, refrigerant in conduit 78 is desuperheated by the heat transfer to refrigerant in superheater 70. The superheated vaporous refrigerant exits superheater 70 through standpipe 74 into conduit 142 into compressor suction conduit 98 and thence into compressor 10 for another cycle through the system.

Another feature of this invention is the provision of superheater 70 which provides two benefits. In contrast to commercially-available systems, the system of this invention does not require an electrically-heated external water tank to cool compressor discharge refrigerant and to heat compressor suction refrigerant. Instead, superheater 70 provides both these functions internally of the system.

The defrost cycle is terminated in one of two ways. When temperature sensor 120 of thermostat 122 senses a predetermined temperature high enough to assure that all frost has melted from evaporator coil 42, it will signal the system controller to terminate the defrost cycle and initiate the refrigeration cycle. This function could also be performed by a pressurestat in conduit 114 which could make the same determination. Alternatively, a time-out feature could be utilized to terminate after a predetermined time.

A return to the refrigeration causes valves 86 and 90 to open, valve 88 to close, and valve 84 to outlet to conduit 102, while closing conduit 130. At the end of the defrost cycle, pressure in conduit 114 is high because of the functioning of pressure regulator 96. The sudden opening of valve 86 exposes the compressor to a high suction pressure which could overload it. This pressure condition is sensed by pressure controller 92 which acts to delay opening of solenoid valve 90 until suction pressure has been reduced to an acceptable level. Bleed conduit 144 is connected to an internal bleed port in valve 84 and functions to draw refrigerant which is in conduit 130 at termination of the defrost cycle back into the system. This utilizes all refrigerant during both cycles and minimizes the refrigerant charge required to operate the system.

Thereafter, the system operates as described above to refrigerate the refrigerated space during the refrigeration cycle.

Figure 3:
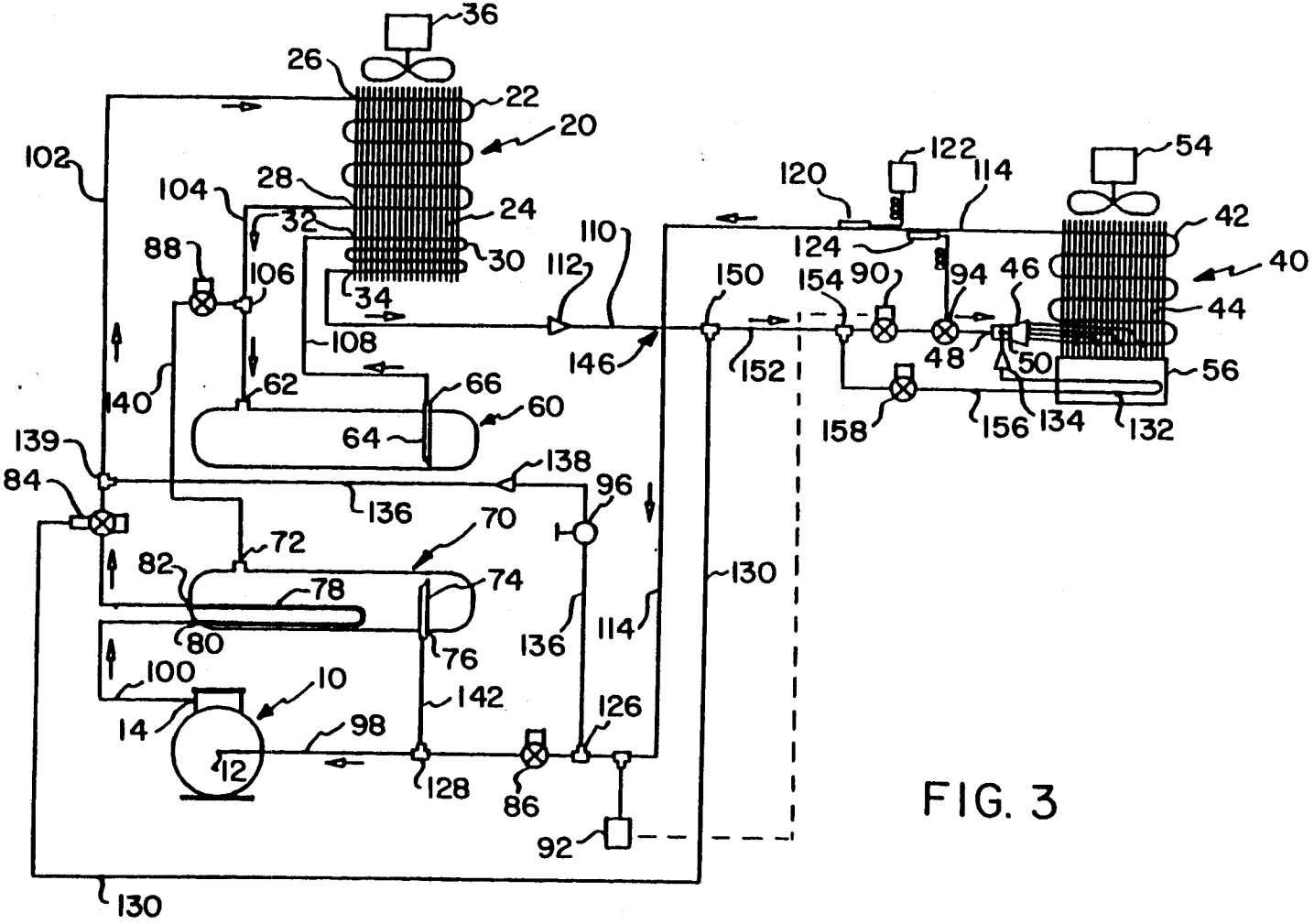
FIG. 3 is a schematic view of another embodiment of a refrigeration system according to this invention, illustrating system operation during the refrigeration cycle.
Figure 4:
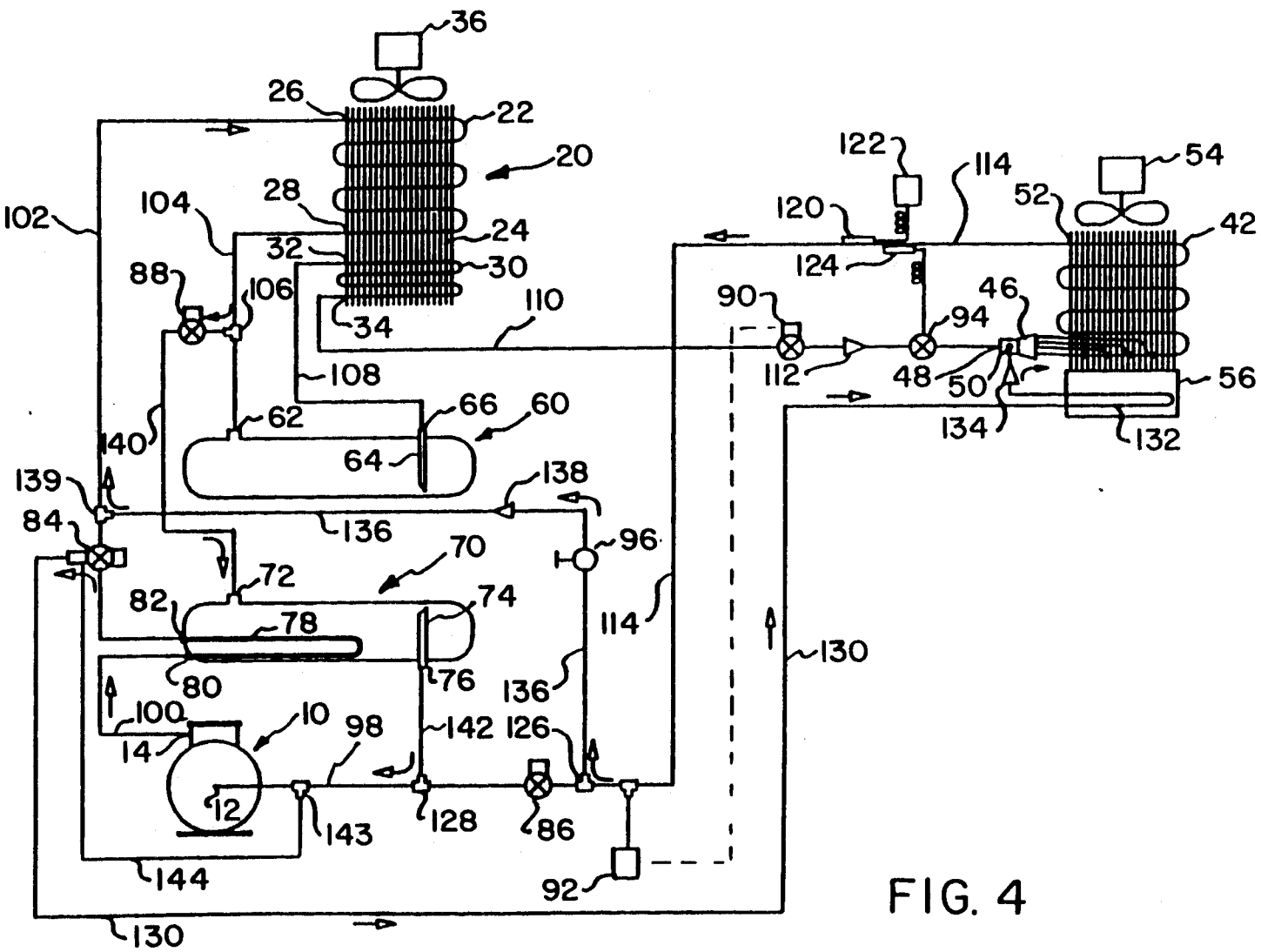
FIG. 4 is another schematic diagram of the FIG. embodiment, illustrating system operation during the defrost cycle.
Figure 5:
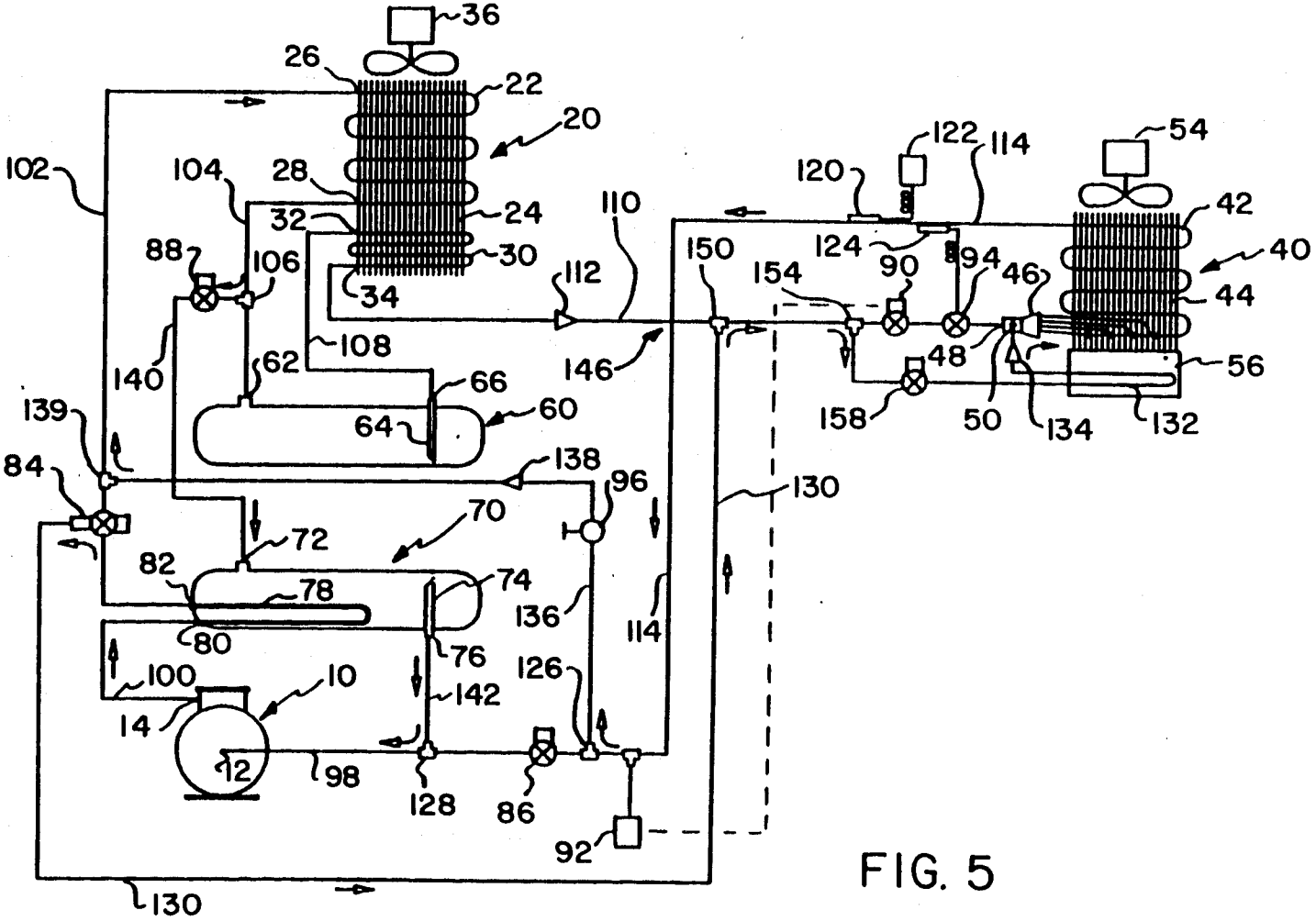
FIG. 5 is another schematic diagram of the FIG. 3 embodiment, illustrating system operation during the defrost cycle.

FIGS. 3 and 5 illustrate another embodiment of this invention, which incorporates only a slight modification of the FIGS. 1 and 4 embodiment just described.

Like elements in the FIGS. 3 and 5 embodiment are identically numbered. The modifications relate to the means of supplying compressor discharge refrigerant to the evaporator during the defrost cycle.

As shown in FIGS. 3 and 5, the defrost cycle evaporator supply conduit 130 is connected into the refrigeration cycle evaporator supply conduit 110 at a tee 150. The supply conduit downstream of tee 150 is denoted 152 and serves to supply the evaporator 40 during both cycles. The purpose of providing this dual-purpose supply conduit is cost saving, since it is this reach of conduit that may stretch considerable distances in practice. It is a cost saving to eliminate this long segment of conduit 130 from the FIG. 1 embodiment.

A tee 154 is provided in conduit 152 to connect a bypass conduit 156 to drain pan heating loop 132 through a solenoid valve 158. Check valve 112 is relocated to a position in conduit 110 upstream of tee 150 to prevent backflow into subcool loop 30 and receiver 60 during the defrost cycle. Shutoff valve 90 is located downstream of tee 154 and functions as before. In this embodiment, the internal bleed port is eliminated from compressor discharge control valve 84, and tee 143 and bleed conduit 144 are also eliminated. Operation of this modified system is little changed from that described above in reference to FIGS. 1 and 3.

During the refrigeration cycle, valve 90 is still open and valve 158 is closed. Liquid refrigerant discharged from subcooling loop 30 flows through check valve 112, conduit 152, valve 90, and expansion valve 94 into distributor 46. Flow into conduit 130 is prevented, since the valve 84 outlet to conduit 130 is closed and bleed conduit 144 was eliminated. Flow into bypass conduit 156 is blocked by closed valve 158.

During the defrost cycle, valve 90 is closed and valve 158 is opened. Hot vaporous refrigerant flows from compressor 10 through conduit 130 to conduit 152. Backflow into subcool loop 30 and receiver 60 is prevented by check valve 112. Closure of valve 90 forces refrigerant to flow through conduit 156 and open valve 156 into distributor side port 50. Any liquid in conduit 152 is forced through evaporator. Since it bypasses expansion valve 94, this warm liquid contributes to the defrosting of coil 42.

Thus, both embodiments of the invention described above provide a refrigeration system which provides a hot gas defrost cycle that employs the condenser as a reevaporator and utilizes heat exchange between compressor discharge and suction refrigerant to enhance defrosting action and system efficiency.

I claim:

1. A hot gas defrost refrigeration system having a compressor, a condenser, an evaporator, each having inlets and outlets interconnected by fluid passage means and incorporating valve means to cause refrigerant to discharge from the compressor and flow sequentially through the condenser and the evaporator to the compressor during the refrigeration cycle, and to discharge from the compressor and flow through the evaporator to the compressor during the defrost cycle, characterized by defrost passage means including compressor discharge valve means for directing refrigerant from the evaporator outlet to the condenser inlet and from the condenser outlet to the compressor inlet during the defrost cycle, thereby utilizing the condenser as a reevaporator during the defrost cycle, further characterized by a superheater in the defrost passage means adapted to receive refrigerant from the condenser outlet during the defrost cycle, and the passage means connecting the compressor outlet with the evaporator inlet including a superheat passage in heat exchange relationship with the superheater for transferring heat from the refrigerant discharged from the compressor outlet to the refrigerant delivered to the compressor inlet during the defrost cycle to enhance operation of the system during the defrost cycle.

2. The refrigeration system of claim 1, further characterized by including evaporator inlet valve means, and by the compressor discharge passage means including compressor discharge valve means, a first conduit connecting the compressor discharge valve means with the condenser inlet during the refrigeration cycle, and a second conduit connecting the compressor discharge valve means with the evaporator inlet valve means during the defrost cycle.

3. The refrigeration system of claim 2, further characterized by a superheater located in the defrost passage means for receiving refrigerant from the condenser and delivering it to the compressor during the defrost cycle, and by the second conduit having a superheat portion in heat exchange relationship with the superheater, thus enabling heat transfer from the compressor discharge refrigerant to the compressor suction refrigerant during the defrost cycle to superheat the compressor suction refrigerant, to assure it is vaporous, and to desuperheat the vaporous refrigerant delivered to the evaporator, thus enhancing operation of the system during the defrost cycle.

4. The refrigeration system of claim 3, further characterized by the defrost passage means including a bypass conduit connecting the evaporator outlet with the condenser inlet, and by the compressor inlet valve means including a one-way valve for permitting refrigerant flow from the evaporator outlet to the condenser inlet during the defrost cycle, but preventing reverse flow during the refrigeration cycle.

5. The refrigeration system of claim 4, further characterized by the condenser outlet passage means including an evaporator supply conduit connected to the evaporator inlet valve means and a second one-way valve connecting the condenser outlet to said conduit for enabling refrigerant flow from the condenser outlet to the evaporator inlet, while preventing reverse flow, the second conduit of the compressor discharge passage means connecting to the evaporator supply conduit to utilize the evaporator supply conduit to convey refrigerant from the condenser to the evaporator during the refrigeration cycle, and to convey refrigerant from the compressor to the evaporator during the defrost cycle.

6. The refrigeration system of claim 5, further characterized by the evaporator inlet valve means including a pressure responsive valve, and the evaporator outlet passage means including a pressure sensor for controlling said pressure responsive valve to limit the pressure of compressor suction refrigerant during initiation of the refrigeration cycle following termination of the defrost cycle.

7. The refrigeration system of claim 2, wherein the evaporator includes a drip pan for collecting and draining off water collected from melted frost during the defrost cycle, further characterized by the evaporator inlet valve means including a refrigerant passage in heat exchange relationship with the drip pan for heating the pan during the defrost cycle to prevent freezing of the water in the pan.

8. The refrigeration system of claim 2, further characterized by a defrost valve in the defrost passage means operable to permit refrigerant flow to the superheater only during the defrost cycle.

9. The refrigeration system of claim 2, further characterized by the evaporator inlet valve means including an evaporator supply conduit connected to the condenser discharge passage means, a portion of the evaporator supply conduit being in heat exchange relationship with the evaporator outlet passage means.

10. The refrigeration system of claim 2, further characterized by the defrost passage means including a bypass conduit connecting the evaporator outlet with the condenser inlet, and by the compressor suction valve means including a one-way valve operable to permit refrigerant flow from the evaporator outlet to the condenser inlet during the defrost cycle, but preventing reverse flow during the refrigeration cycle.

11. The refrigeration system of claim 2, further characterized by a refrigerant receiver in the condenser outlet passage means for receiving refrigerant from the condenser during the refrigeration cycle.

12. The refrigeration system of claim 11, further characterized by a superheater located in the defrost passage means, a superheater valve connecting the condenser outlet to the superheater and operable to bypass the receiver and direct refrigerant from the condenser through the superheater to the compressor during the defrost cycle, and by the second conduit having a superheat portion in heat exchange relationship with the superheater, thus enabling heat transfer from the compressor discharge refrigerant to the compressor suction refrigerant during the defrost cycle to superheat the compressor suction refrigerant, to assure it is vaporous, and to desuperheat the vaporous refrigerant delivered to the evaporator, thus enhancing operation of the system during the defrost cycle.

13. The refrigeration system of claim 12, further characterized by the defrost passage means including a bypass conduit connecting the evaporator outlet with the condenser inlet, and by the compressor suction valve means including a one-way valve operable to permit refrigerant flow from the evaporator outlet to the condenser inlet during the defrost cycle, but preventing reverse flow during the refrigeration cycle.

14. The refrigeration system of claim 13, further characterized by an evaporator supply conduit connected to the evaporator inlet valve means and a second one-way valve connecting the condenser outlet to said conduit for enabling refrigerant flow from the condenser outlet to the evaporator inlet, but preventing reverse flow.

15. The refrigeration system of claim 14, further characterized by the evaporator inlet valve means including a pressure responsive valve, and the evaporator outlet passage means including a pressure sensor for controlling said pressure responsive valve to limit the pressure of compressor suction refrigerant during initiation of the refrigeration cycle following termination of the defrost cycle.

16. The refrigeration system of claim 15, wherein the evaporator includes a drip pan for collecting and draining off water collected from melted frost during the defrost cycle, further characterized by the evaporator inlet valve means including a refrigerant passage in heat exchange relationship with the drip pan for heating the pan during the defrost cycle to prevent freezing of the water in the pan.

17. The refrigeration system of claim 16, further characterized by a defrost valve in the defrost passage means operable to permit refrigerant flow to the superheater only during the defrost cycle.

18. The refrigeration system of claim 17, further characterized by the evaporator inlet valve means including an evaporator supply conduit connected to the condenser discharge passage means, a portion of the evaporator supply conduit being in heat exchange relationship with the evaporator outlet passage means.

19. A refrigerant system having refrigeration and defrost cycles comprising:

a compressor having suction and discharge ports, a condenser having an inlet and an outlet, a refrigerating evaporator subject to frosting and having an inlet, including inlet valve means, and an outlet, compressor discharge passage means for directing refrigerant from the compressor to the condenser inlet during the refrigeration cycle, and to the evaporator inlet during the defrost cycle, condenser outlet passage means for directing refrigerant from the condenser outlet to the evaporator inlet valve means during the refrigeration cycle, and evaporator outlet passage means for directing refrigerant from the evaporator outlet to the compressor suction port during the refrigeration and the defrost cycles, characterized by defrost passage means for directing refrigerant from the evaporator outlet to the condenser inlet and from the condenser outlet to the compressor suction port, and compressor suction valve means in the evaporator outlet passage means for blocking refrigerant flow directly to the compressor from the evaporator and directing refrigerant flow through the defrost passage means during the defrost cycle, thereby utilizing the condenser as a reevaporator during the defrost cycle.

20. The refrigerant system of claim 19, further characterized by the compressor discharge passage means including compressor discharge valve means, a first conduit connecting said valve means to the condenser inlet, and a second conduit connecting said valve means to the evaporator inlet valve means, said discharge valve means being operable to direct refrigerant to the first conduit during the refrigeration cycle, and to the second conduit during the defrost cycle.

21. The refrigeration system of claim 20, further characterized by a superheater located in the defrost passage means for receiving refrigerant from the condenser and delivering it to the compressor during the defrost cycle, and by the compressor discharge valve means including a superheat conduit in heat exchange relationship with the superheater, thus enabling heat transfer from compressor discharge refrigerant to compressor suction refrigerant during the defrost cycle to superheat compressor suction refrigerant, to assure it is vaporous, an desuperheat the vaporous refrigerant delivered to the evaporator, thus enhancing operation of the system during the defrost cycle.

22. The refrigeration system of claim 21, further characterized by a condenser discharge valve in the defrost passage means operable to permit refrigerant flow from the condenser to the superheater only during the defrost cycle.

23. The refrigeration system of claim 21, wherein the evaporator inlet valve means include an expansion valve and a refrigerant distributor, further characterized by the second conduit bypassing the expansion valve and connecting to the distributor.

24. The refrigeration system of claim 21, further characterized by the defrost passage means including a bypass conduit connecting the evaporator outlet with the condenser inlet, and by the compressor suction valve means including a one-way valve operable to permit refrigerant flow through the bypass conduit from the evaporator outlet to the condenser inlet during the defrost cycle, but preventing reverse flow during the refrigeration cycle.

25. The refrigeration system of claim 24, further characterized by the condenser outlet passage means including an evaporator supply conduit connected to the evaporator inlet valve means and a second one-way valve connecting the condenser outlet to said conduit for enabling refrigerant flow from the condenser outlet to the evaporator inlet while preventing reverse flow, the second conduit of the compressor discharge passage means connecting to the evaporator supply conduit to utilize the evaporator supply conduit to convey refrigerant from the condenser to the evaporator during the refrigeration cycle, and to also convey refrigerant from the compressor to the evaporator during the defrost cycle.

26. The refrigerant system of claim 25, wherein the evaporator inlet valve means include an expansion valve and a refrigerant distributor, further characterized by a bypass conduit connecting the evaporator supply conduit with the distributor, and the evaporator inlet valve means being operable to deliver refrigerant through the expansion valve during the refrigeration cycle and to bypass the expansion valve during the defrost cycle.

27. The refrigeration system of claim 20, further characterized by the defrost passage means including a bypass conduit connecting the evaporator outlet with the condenser inlet, and by the compressor suction valve means including a one-way valve for permitting refrigerant flow from the evaporator outlet to the condenser inlet during the defrost cycle, but preventing reverse flow during the refrigeration cycle.

28. The refrigeration system of claim 27, further characterized by an evaporator supply conduit connected to the evaporator inlet valve means and a second one-way valve connecting the condenser outlet to said conduit for enabling refrigerant flow from the condenser outlet to the evaporator inlet, while preventing reverse flow, the second conduit of the compressor discharge passage means connecting to the evaporator supply conduit, thereby utilizing the evaporator supply conduit to convey refrigerant from the condenser to the evaporator during the refrigeration cycle, and to convey refrigerant from the compressor to the evaporator during the defrost cycle.

29. The refrigeration system of claim 20, further characterized by an evaporator supply conduit connected to the evaporator inlet valve means and a second one-way valve connecting the condenser outlet to said conduit for enabling refrigerant flow from the condenser outlet to the evaporator inlet, while preventing reverse flow, the second conduit of the compressor discharge passage means connecting to the evaporator supply conduit, thereby utilizing the evaporator supply conduit to convey refrigerant from the condenser to the evaporator during the refrigeration cycle, and to convey refrigerant from the compressor to the evaporator during th defrost cycle.

30. The refrigeration system of claim 29, wherein th evaporator inlet valve means include an expansio valve and a refrigerant distributor, further characterized by a bypass conduit connecting the evaporato supply conduit with the distributor, and the evaporato inlet valve means being operable to deliver refrigeran through the expansion valve during the refrigeratio cycle and to bypass the expansion valve during th defrost cycle.

31. The refrigeration system of claim 20, further char acterized by a refrigerant receiver in the condense outlet passage means for receiving refrigerant from th condenser during the refrigeration cycle.

32. The refrigeration system of claim 31, further char acterized by a superheater located in the defrost passag means, a superheater valve connecting the condense outlet to the superheater and operable to bypass th receiver and direct refrigerant from the condense through the superheater to the compressor during th defrost cycle, and by the second conduit having a por tion in heat exchange relationship with the superheater thus enabling heat transfer from the compressor dis charge refrigerant to the compressor suction refrigeran during the defrost cycle to superheat the compresso suction refrigerant, to assure it is vaporous, and to desu perheat the vaporous refrigerant delivered to the evap orator, thus enhancing operation of the system durin the defrost cycle.

33. A refrigeration system having refrigeration anc defrost cycles comprising:

a compressor having suction and discharge ports connected to suction and discharge conduits, a condenser having an inlet and an outlet, a refrigerating evaporator subject to frosting and having an inlet, including inlet valve means, and an outlet, a compressor discharge valve in the compressor discharge conduit for directing refrigerant from the compressor through a first conduit to the condenser inlet during the refrigeration cycle, and through a second conduit to the evaporator inlet during the defrost cycle, condenser outlet passage means for directing refrigerant from the condenser outlet to the evaporator inlet valve means during the refrigeration cycle, evaporator outlet passage means for directing refrigerant from the evaporator outlet to the compressor suction conduit during the refrigeration and the defrost cycles, and a system controller controlling operation of the refrigeration and defrost cycles, characterized by a superheater in heat exchange relationship with the compressor discharge conduit, defrost passage means including a first defrost conduit for directing refrigerant from the evaporator outlet to the condenser inlet, and a second defrost conduit for directing refrigerant from the condenser outlet to the superheater and then to the compressor suction conduit, a compressor suction control valve in the compressor suction conduit, a condenser discharge control valve in the condenser outlet passage means, the evaporator inlet valve means including an inlet control valve, and the system controller being operable to operate the control valves to block refrigerant flow directly to the compressor from the evaporator and to direct refrigerant flow through the defrost passage means during the defrost cycle, thereby utilizing the condenser as a reevaporator during the defrost cycle, and to prevent such flow through the defrost passage means during the refrigeration cycle.

34. The refrigeration system of claim 33, further characterized by the defrost passage means including a one-way valve in the first defrost conduit operable to permit refrigerant flow from the evaporator outlet to the condenser inlet during the defrost cycle, but preventing reverse flow during the refrigeration cycle, and a second one-way valve in the condenser outlet passage means for enabling refrigerant flow from the condenser outlet to the evaporator inlet, but preventing reverse flow.

35. The refrigerant system of claim 34, wherein the evaporator inlet valve means include an expansion valve and a refrigerant distributor, further characterized by the second conduit bypassing the expansion valve and connecting to the distributor.

36. The refrigeration system of claim 34, further characterized by the second conduit connecting to the evaporator supply conduit downstream of the second one-way valve to utilize the evaporator supply conduit to convey refrigerant from the condenser to the evaporator during the refrigeration cycle, and to also convey refrigerant from the compressor to the evaporator during the defrost cycle.

37. The refrigerant system of claim 36, wherein the evaporator inlet valve means include an expansion valve and a refrigerant distributor, further characterized by a bypass conduit connecting the evaporator supply conduit with the distributor, and the evaporator inlet valve means being operable to deliver refrigerant through the expansion valve during the refrigerant cycle and to bypass the expansion valve during the defrost cycle.

38. The refrigerant system of claim 34, wherein the evaporator includes a drip pan for collecting and draining off water collected from melted frost during the defrost cycle, further characterized by the evaporator inlet valve means including a refrigerant passage in heat exchange relationship with the drip pan for heating the pan during the defrost cycle to prevent freezing of the water in the pan.

39. The refrigeration system of claim 34, further characterized by the evaporator inlet valve means including an evaporator supply conduit connected to the condenser discharge passage means, a portion of the evaporator supply conduit being in heat exchange relationship with the evaporator outlet passage means.

40. The refrigeration system of claim 34, further characterized by the evaporator outlet passage means including a pressure sensor for controlling evaporator inlet control valve to limit the pressure of compressor suction refrigerant during initation of the refrigeration cycle following termination of the defrost cycle.

* * * * *